United States Patent [19]

Cartledge

[11] Patent Number: 4,712,820

[45] Date of Patent: Dec. 15, 1987

[54] DOCUMENT CARRIER

[75] Inventor: Robert Cartledge, McKinney, Tex.

[73] Assignee: Shepard & Associates, Dallas, Tex.

[21] Appl. No.: 930,467

[22] Filed: Nov. 14, 1986

[51] Int. Cl.[4] ..... G09F 3/18

[52] U.S. Cl. ..... 294/138; 150/52 R

[58] Field of Search ..... 294/138; 229/87 R, 87.5; 150/52 R, 52 B; 206/495, 412, 449; 40/10 B, 53 D

[56] References Cited

U.S. PATENT DOCUMENTS

| | | | |
|---|---|---|---|
| 741,400 | 10/1903 | Harrington | 294/138 |
| 2,293,979 | 8/1942 | Hopkins | 150/52 R |
| 2,346,908 | 4/1944 | Corley | 150/52 R |
| 4,530,175 | 7/1985 | Wellman | 150/52 R |

*Primary Examiner*—James B. Marbert

*Attorney, Agent, or Firm*—Howard R. Greenberg

[57] ABSTRACT

A carrier for conveniently storing, transporting and viewing documents, such as blueprints, is provided through two durable, pliable flaps affixed to one another at one end, between which the documents are placed. The bottom flap is longer than the top flap so that when in an unrolled state for viewing the documents, the free end of the bottom flap may be turned over to rest on the documents to retain them in a flat, unrolled, easily viewable position even in the presence of wind gusts. The flaps and documents therebetween are rolled up and bound by a strap for convenient transportation thereof.

12 Claims, 2 Drawing Figures

DOCUMENT CARRIER

BACKGROUND OF THE INVENTION

The present invention pertains generally to containers for storing documents and specifically to such containers employed for transporting the documents about.

Various means have been developed for conveniently storing documents in a rolled form. Such a means is disclosed in U.S. Pat. No. 4,505,424issued to Chappars. The means disclosed therein for storing rolled documents, however, like others in the prior art, do not afford facile transportability and viewing of the documents in addition to their convenient storage. The first two mentioned functions are extremely important in the case of certain documents, such as blueprints, which quite often must be carried to the field for viewing in an open environment. Viewing the blueprints can be rendered somewhat difficult in the presence of wind gusts which tend to blow unsecured documents about.

With the foregoing in mind, it is a primary object of the present invention to provide a means for conveniently storing documents in a rolled position.

It is a further object of the present invention to provide such a means which also affords easily transporting and viewing the documents.

It is still a further object of the present invention to provide such a means which is aesthetically appealing and easily fabricated.

SUMMARY OF THE INVENTION

In accordance with the stated objects, the document carrier invention herein affords convenient storage, transportability and viewing of documents through an arrangement comprising two flaps formed from a durable, pliable material, such as heavy duty vinyl, which are affixed to one another at one end, such as through grommets. The documents are laid between the flaps and may be secured in place at the affixed end by a binding clamp. To afford easy viewing of the top document, the top flap preferably is made from transparent vinyl. The bottom flap is longer than the top one so that its free end can be placed over the documents to retain them in a flat position when the carrier is in an unrolled state for viewing the documents. A metal rod affixed to the longer flap along its free end can be used to provide additional weight for retaining the documents in a flat, easily viewable position, even in the presence of wind gusts. Pocket compartments provided as part of the bottom flap at its free end on its exposed surface when it is placed over the documents affords easy access to writing and measuring implements for use by the viewers. At least one strap, such as made from VELCRO material, is provided for binding the flaps when in a rolled state. A strap type handle is provided, for holding the carrier during transportation.

DETAILED DESCRIPTION OF THE PREFERRED EMBODIMENT

Figure 1:
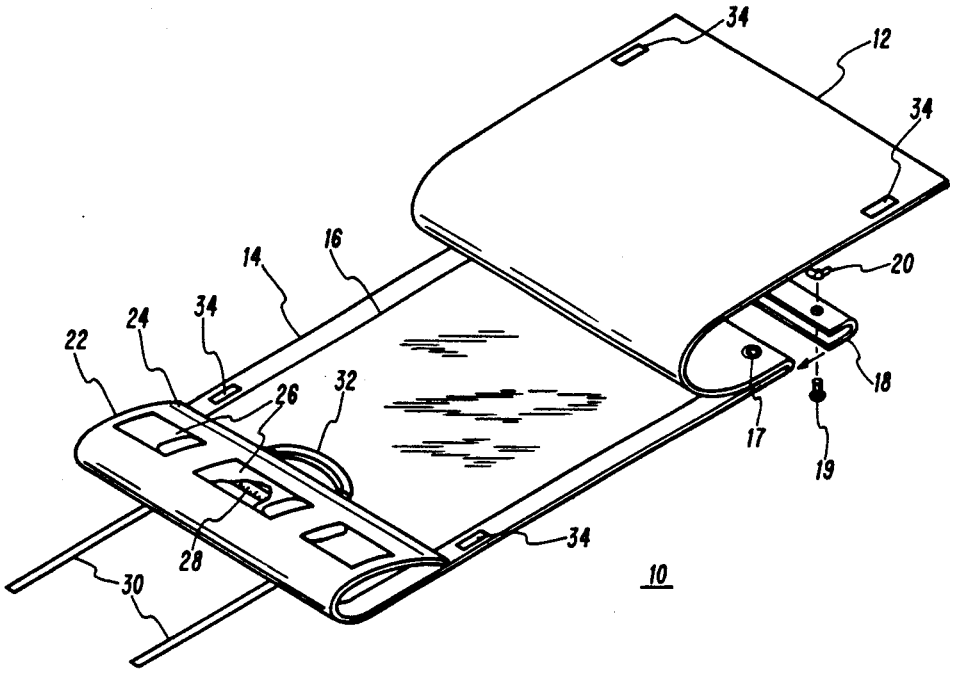
FIG. 1 is an isometric view of the document carrier in an rolled state for viewing the documents.
Figure 2:
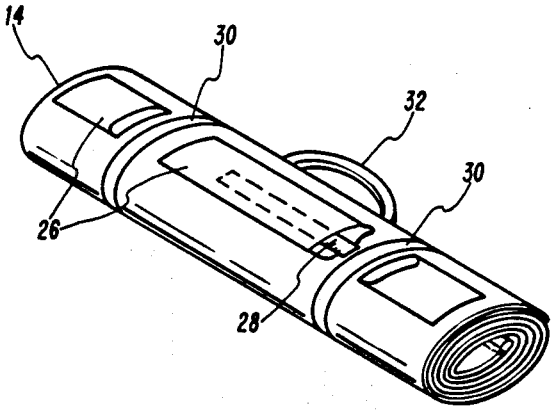
FIG. 2 is an isometric view of the document carrier in a rolled transportation state.

As shown in FIG. 1, the document carrier, designated generally as 10, comprises a top flap 12 and a longer bottom flap 14 between which the documents such as top document 16 are placed. The flaps are made from a durable, pliable material, such as heavy-duty vinyl which are folded or affixed at one end, such as through grommets (one grommet 17 being shown in FIG. 1). A binding clamp 18, which may be tightened through a screw 19 passed through grommet 17 and a wing nut 20, may be used to secure the documents by emplacement over the affixed end. The use of transparent vinyl for the top flap 12 permits the top document 16 to be conveniently viewed even without lifting the top flap 12 as depicted in FIG. 1.

The longer length of bottom flap 14, vis-a-vis top flap 12 which should be at least as long as the longest document contemplated, permits its free end 22 to be placed over the documents during the unrolled viewing state, thereby retaining the documents in a flat easily viewable position even in the presence of wind gusts. A metal rod 24 affixed to the bottom flap 14 along its free end, such as by sewing the vinyl material of the bottom flap 14 around rod 24, can provide additional weight if necessary or desired. Pocket compartments 26 affixed to the bottom flap 14 in the vicinity of its free end 22 on its exposed surface when turned over onto the documents, provides readily accessable storage areas for writing and measuring implements such as ruler 28.

A pair of VELCRO material straps 30 are affixed to the bottom flap 14 for binding the carrier 10 when in a rolled state for transporting the documents. A handle strap 32 affixed to bottom flap 14 permits the carrier 10 to be conveniently held during transportation thereof. Additionally, VELCRO material strips 34 along the sides of bottom flap 14 and top flap 12 may be employed for adherence purposes to permit the top document to be viewed without even lifting top flap 12 when its material is transparent.

As demonstrated by the foregoing Detailed Description, the invention herein affords a convenient carrier for storing, transporting and viewing documents, even in the field in an open environment in the presence of wind gusts. The carrier is easily fabricated with conventional materials and standard techniques, presenting an aesthetic appearance. Since modifications which do not necessarily depart from the scope and spirit of the invention herein, may very well occur to those skilled in the art, the foregoing detailed description should be construed as merely exemplary and not circumscriptive of the invention as it will now be claimed hereinbelow.

What is claimed is:

1. A document carrier for storing and transporting documents such as blueprints, comprising:

a pair of flaps of durable pliable material affixed at one end between which the documents are placed, one of said flaps being longer than the other so as to enable the free end to be placed over the documents when in an unrolled viewing state., at least one strap affixed to one of said flaps for binding said pair of flaps when in a rolled state, and a strap handle affixed to one of said flaps for holding said pair of flaps when in a rolled state.

2. The document carrier of claim 1 wherein the shorter flaps consists of a transparent material.

3. The document carrier of claim 2 including a pocket compartment affixed to the longer flap in the vicinity of its free end on its exposed surface when said longer flap is placed over the documents.

4. The document carrier of claim 3 wherein said flaps are affixed to one another through a binding clamp.

5. The document carrier of claim 4 including an elongated metal weight affixed to said longer flap along its free end.

6. The document carrier of claim 1 including a pocket compartment affixed to the longer flap in the vicinity of its free end on its exposed surface when said longer flap is placed over the documents.

7. The document carrier of claim 6 wherein said flaps are affixed to one another through a binding clamp.

8. The document carrier of claim 4 including an elongated metal weight affixed to said longer flap along its free end.

9. The document carrier of claim 1 wherein said flaps are affixed to one another through a binding clamp.

10. The document carrier of claim 4 including an elongated metal weight affixed to said longer flap along its free end.

11. The document carrier of claim 1 including an elongated metal weight affixed to said longer flap along its free end.

12. The document carrier of claim 2 including VELCRO material strips attached to said flaps for adhering said flaps to one another.

* * * * *